US010946943B2

(12) United States Patent
Builder et al.

(10) Patent No.: US 10,946,943 B2
(45) Date of Patent: Mar. 16, 2021

(54) MODULAR INFLATABLE AND PLATFORM DOCKING STATIONS AND METHOD OF CONSTRUCTION THEREFOR

(71) Applicants: Nautibuoy Marine Limited, Devon (GB); Clay Livingston Builder, Devon (GB); Nina Anderson, Devon (GB)

(72) Inventors: Clay Livingston Builder, Devon (GB); Nina Anderson, Devon (GB)

(73) Assignee: Nautibuoy Marine Limited, Devon (GB)

( * ) Notice: Subject to any disclaimer, the term of this patent is extended or adjusted under 35 U.S.C. 154(b) by 0 days.

(21) Appl. No.: 16/334,102

(22) PCT Filed: Sep. 19, 2017

(86) PCT No.: PCT/EP2017/073679
§ 371 (c)(1),
(2) Date: Mar. 18, 2019

(87) PCT Pub. No.: WO2018/050929
PCT Pub. Date: Mar. 22, 2018

(65) Prior Publication Data

US 2019/0308698 A1 Oct. 10, 2019

(30) Foreign Application Priority Data

Sep. 19, 2016 (GB) ..... 1615939
Nov. 3, 2016 (GB) ..... 1618539

(51) Int. Cl.
*B63C 1/04* (2006.01)
*B63B 7/08* (2020.01)
(Continued)

(52) U.S. Cl.
CPC ..... *B63C 1/04* (2013.01); *B63B 7/08* (2013.01); *B63B 34/00* (2020.02); *B63B 35/34* (2013.01);
(Continued)

(58) Field of Classification Search
CPC .. B63C 1/04; B63C 1/02; B63B 34/00; B63B 7/08; B63B 35/34; B63B 35/36; B63B 35/38; B63B 35/613; F02B 17/00
See application file for complete search history.

(56) References Cited

U.S. PATENT DOCUMENTS 4,727,820 A 3/1988 Klaus
7,051,668 B1 5/2006 Quinto
(Continued)

FOREIGN PATENT DOCUMENTS

FR 2754513 A1 4/1998
JP H10-297587 11/1998
(Continued)

*Primary Examiner* — Stephen P Avila
(74) *Attorney, Agent, or Firm* — Optimus Patents US, LLC

(57) ABSTRACT

An inflatable water-based motorised device docking station is described. The inflatable water-based motorised device docking station includes an inflatable tube configurable to form an open ended area to receive a water-based motorised device; a floor area coupled to a portion of the inflatable tube; and a ballast bag with dump attached to the floor area and configured to stabilise the inflatable water-based motorised device docking station.

10 Claims, 11 Drawing Sheets

(51) Int. Cl.

| | |
|---|---|
| ***B63B 35/38*** | (2006.01) |
| ***E02B 17/00*** | (2006.01) |
| ***B63B 35/34*** | (2006.01) |
| ***B63C 1/02*** | (2006.01) |
| ***B63B 35/36*** | (2006.01) |
| ***B63B 35/613*** | (2006.01) |
| ***B63B 34/00*** | (2020.01) |

(52) U.S. Cl.
CPC ..... *B63B 35/36* (2013.01); *B63B 35/38* (2013.01); *B63B 35/613* (2013.01); *B63C 1/02* (2013.01); *E02B 17/00* (2013.01); *B63B 2207/00* (2013.01)

(56) References Cited

U.S. PATENT DOCUMENTS

| | | | | |
|---|---|---|---|---|
| 9,340,262 | B1 | 5/2016 | Boyd et al. | |
| 2002/0129756 | A1* | 9/2002 | Myers ..... | B63B 1/121 114/354 |
| 2007/0181050 | A1 | 9/2007 | Stillman | |

FOREIGN PATENT DOCUMENTS

| | | | |
|---|---|---|---|
| WO | 97/39940 | A1 | 10/1997 |
| WO | 20090156789 | A1 | 12/2009 |

* cited by examiner

MODULAR INFLATABLE AND PLATFORM DOCKING STATIONS AND METHOD OF CONSTRUCTION THEREFOR

FIELD OF THE INVENTION

The field of this invention relates to an inflatable docking station for individual water-based mobile motorised devices, and method of construction therefore. In particular, the field relates to multiple inflatable docking stations that can be linked together, on their own or to an existing inflatable platform, for example for Seabobs™ or jet skis or stand up jet-skis, or the like.

BACKGROUND OF THE INVENTION

Inflatable work platforms have become popular as solutions for many applications whilst on water. For example, such inflatable work platforms enable easy boat or yacht maintenance. Other example applications include leisure activities, such as sunbathing, or diving platforms. They also provide a readily extendable deck space or additional work space for boats or yachts.

Seabobs (namely motorised water-based surface & underwater hand-held motorised transport devices) and jet-skis (above water motorised transport devices), to name a few, have become more and more popular in recent years. Seabob and jet-ski hiring stations are opening up and a need has arisen for a way of securing the Seabobs and jet-skis as well as a suitable platform to allow easy pre-training of potential renters and users on how to use the Seabobs™ and jet-skis and stand up jet-skis, without the rider shooting off at high speed.

Seabobs and jet-skis were initially sold for land-based storage, but have more recently become more popular amongst the yachting community and at seaside and dive resorts. This has led to a need for securing fixing of the Seabobs and jet-skis whilst on the sea, when swells can move the Seabob around significantly. Seabobs are known to be relatively heavy to lift in and out of the water, the lightest model being 29 kg and the heaviest being 35 kg. Currently, Seabobs are lifted by hand into or out from the water onto yachts, and jet-skis lifted by cranes into or out from the water onto yachts, which is time consuming and heavy work disliked by the yachting crew (and/or owner). Therefore, more often than not, the jet-skis stay in the water all the time and are tied to the back of the yachts where they can be damaged from hitting each other or the back of the yacht transom in swells. Given the cost of Seabobs, in a price range of around €10 k, a more secure and reliable system is needed, particularly one that may avoid the heavy lifting of water-based motorised devices into and from, say, a yacht.

Additionally, it is known that stand up jet-skis are susceptible to sinking, in between uses (they have been known to sink to the bottom of the sea). Furthermore, stand up jet-skis are susceptible to their engines being flooded. Hence, it is desirable to find a way of securing stand up jet-skis, as well as standard jet-skis, in between successive uses.

Hence, attempts for a yet further application for inflatable 'work' platforms has been tried, namely to provide a platform that includes multiple docking station for Seabobs. However, safely securing a relatively heavy Seabob has proved problematic, not only to offer protection for the Seabob, but also a place to secure them (when not in use) in the water.

Furthermore, the inventor of the present invention has recognised and appreciated that only one present design includes retaining straps to prevent loss of seabobs in swell. However, this retaining strap is less than ideal as it runs the whole width of the docking station, having to go between both handles of the Seabob, and as such is overly complex in design and difficult for the user to remove, use the Seabob, and return to secure the Seabob, especially whilst at water level. Furthermore, there are a number of current inflatable docking stations of varying shapes and designs, which are large to store as they are each designed as a large and fixed shape to accommodate multiple water-based motorised devices.

Thus, none of the known techniques describe an adequate drive in/drive out solution to securing an individual water-based motorised device, for example a Seabob, a stand up jet-ski, or a standard jet-ski.

SUMMARY OF THE INVENTION

Accordingly, the invention seeks to mitigate, alleviate or eliminate one or more of the above mentioned disadvantages, either singly or in any combination. Aspects of the invention provide a modular design for an inflatable docking station, for example to secure Seabobs, and a method of construction therefore. Further aspects provide for an inflatable docking station with a unique Ballast and Dump, and a drive in/drive out solution for a water-based motorised device.

These and other aspects of the invention will be apparent from, and elucidated with reference to, the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the FIGs are illustrated for simplicity and clarity and have not necessarily been drawn to scale.

DETAILED DESCRIPTION

As the illustrated examples of the present invention may for the most part, be implemented using electronic components and circuits known to those skilled in the art, details will not be explained in any greater extent than that considered necessary as illustrated below, for the understanding and appreciation of the underlying concepts of the present invention and in order not to confuse or distract from the teachings of the present invention.

Although examples of the invention are described with reference to various sizes and shapes of inflatable platforms and inflatable water-based motorised device docking stations, e.g. a Seabob docking station, or a jet-ski docking station, it is envisaged that other sizes and shapes of inflatable platforms and inflatable water-based motorised device docking stations may benefit from the concepts described herein. Examples of the invention provide for both an individual water-based motorised device docking station with a ballast bag with dump and modular inflatable platform, including modular water-based motorised device docking stations with ballast bag with dump.

Advantageously, the ballast and dump enables the inflatable platform(s) to provide stability of the platform, which is both unique in the context of inflatable platforms and water-based motorised device docking stations, such as a Seabob docking station or a jet-ski docking station. In some examples, the ballast bag with dump also stops the inflatable tube lifting and blowing away when the water-based motorised device is not inside it. It also provides improved resistance to sea swells, so that the platform and docking stations can be used as a training dock. This is in contrast to known docking stations, which are neither individual nor modular in design, nor include a ballast bag with dump mechanism.

Figure 1:
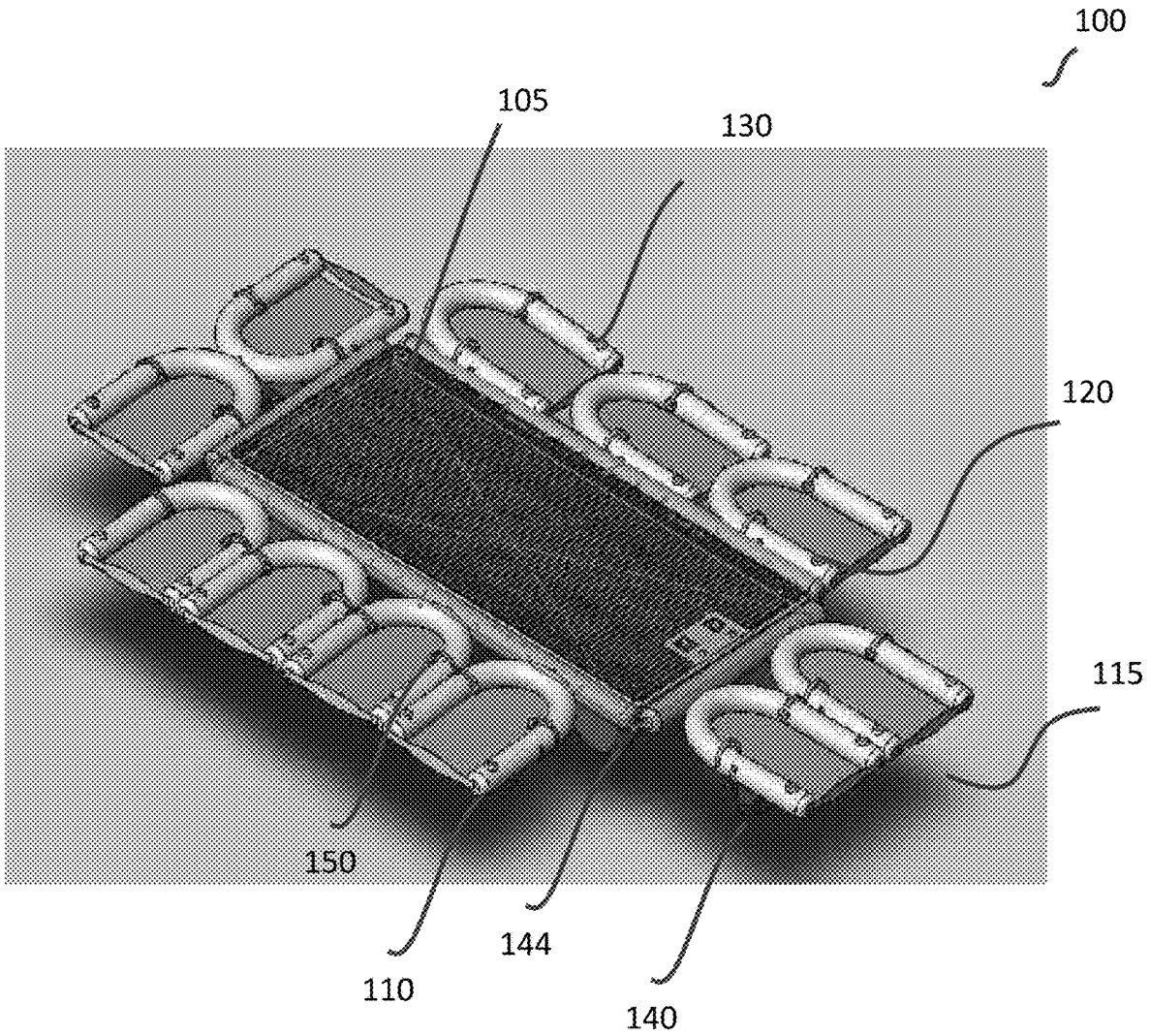
FIG. 1 illustrates an overview of an inflatable platform with Seabob docking stations according to example embodiments of the present invention.

Referring now to FIG. 1, an overview of an inflatable modular platform structure 100, comprising a central inflatable platform 105 coupleable to multiple inflatable water-based motorised device docking stations 115 is illustrated, according to a first example embodiment of the present invention. In this example, an inflatable tube 110, of say 20 cm in diameter, and for example configurable in a substantially U-shaped or V-shaped design, is used as an inflatable docking station for the water-based motorised device, such as Seabobs, as per the drawings. In particular, and advantageously, the configurable inflatable tube 110 may be individually configured and shaped so that it fits either (current) sizes of SeaBobs, e.g. 1152 mm×372 mm as well as 1152 mm×507 mm, e.g. interior dimensions of 1160 mm×600 mm wide. Similarly, the configurable inflatable tube 110 may be configured to provide an interior measurement of 3500 mm×1300 mm for a (standard sit-down) jet-ski, and suitable dimensions for a stand up jet-ski. In the illustrated example, the central inflatable platform 105 is a 2 m×4 m platform, configured for use with water-based motorised device docking stations 115 to accept a Seabob. It is envisaged that, in order to support other water-based motorised device docking stations 115, e.g. able to accept larger jet-skis, fewer water-based motorised device docking stations 115 may be attached. Thus, in this manner and advantageously, the inflatable docking station may be configured to follow the shape of any water-based motorised device design.

Each water-based motorised device docking station 115 includes an inflation valve 120. Furthermore, each water-based motorised device docking station 115 includes a pressure release valve 130. In some examples, the pressure release valve 130 may provide increased safety, such that as pressure increases in high temperatures, the pressure release valve may regulate the pressure to ensure that the tubes 110 don't explode in high heats or put undue pressure on the seams. Although illustrated on the top of the inflatable tube in FIG. 1, it is envisaged that the inflation valve 120 and pressure release valve 130 may be located elsewhere, such as on the ends of the inflatable tube 110.

In this example, the central inflatable platform 105 includes a ballast bag arrangement 144 with manual dump system, and in this particular example four ballast bags, with one on each corner. In this example, each water-based motorised device docking station 115 also includes a ballast bag 140 with manual dump system. In some examples, the ballast bag 140 may be positioned so the dump can be either forward or aft of the docking station, dependent upon the prevalent design considerations. In some examples, the ballast bag 140 may be positioned so the dump is located forward of the docking station and not removable to avoid being stuck in the intake valve of the water-based motorised device. In some examples, the end of the dump may be attached to, say the side of, the inflatable tube 110 to avoid it becoming stuck in the intake valve of the water-based motorised device.

Figure 2:
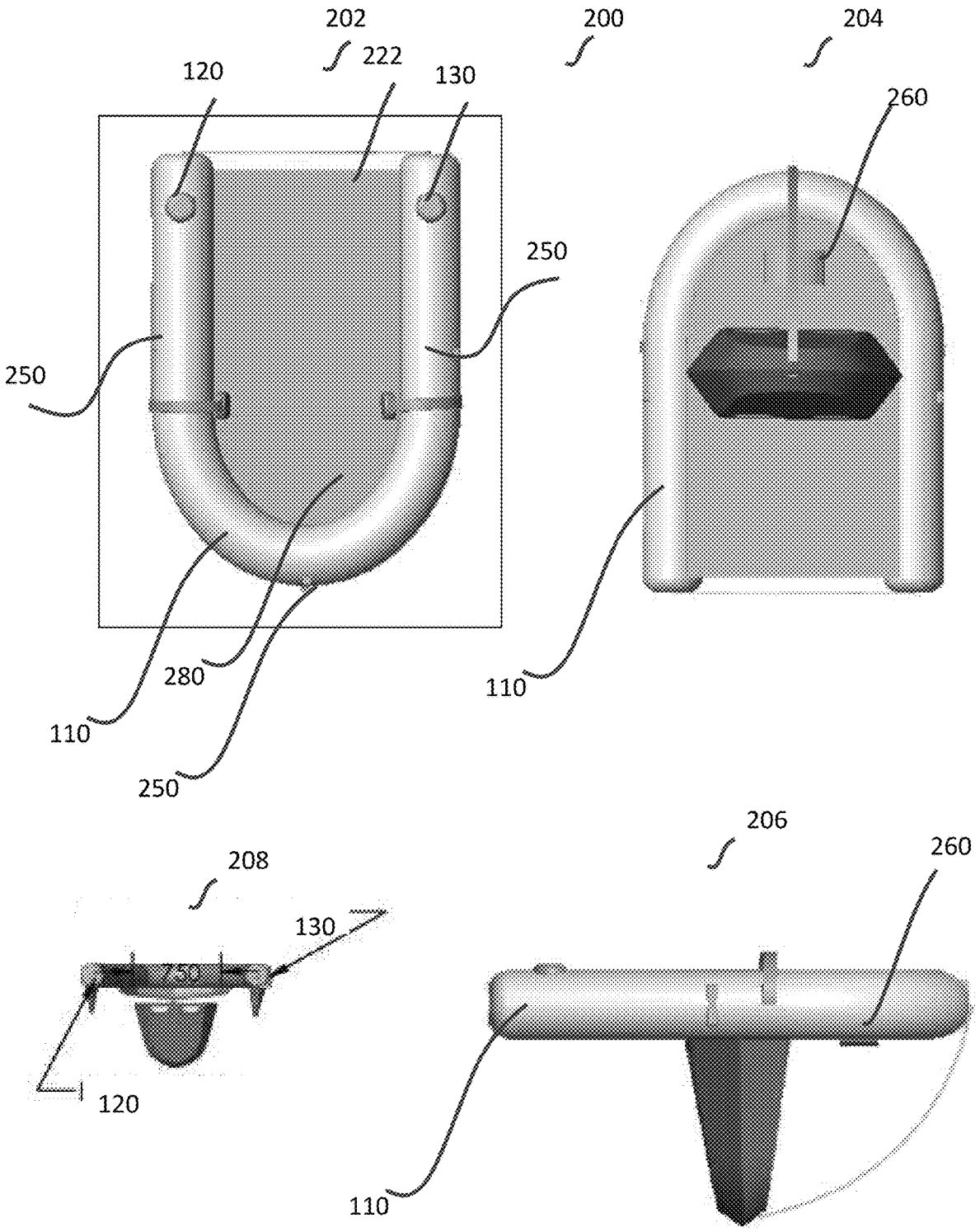
FIG. 2 illustrates an overview various views of an inflatable Seabob docking station according to example embodiments of the present invention.

Referring now to FIG. 2, an overview of various views of an inflatable water-based motorised device docking station is illustrated according to example embodiments of the present invention. A first view 202 illustrates a top plan view of an inflatable water-based motorised device docking station 115. A second view 204 illustrates a bottom plan view of an inflatable water-based motorised device docking station 115. A third view 206 illustrates a side plan view of an inflatable water-based motorised device docking station 115.

Again, in this example, the inflatable water-based motorised device docking station 115 is formed from an inflatable tube 110. Again, each water-based motorised device docking station 115 includes an inflation valve 120 and a pressure release valve 130 (although in other examples, such as example 208, the inflation valve 120 and pressure release valve 130 may be located elsewhere, such as on the ends of the inflatable tube 110).

The water-based motorised device docking station 115 needs to remain in the water. Thus, buoyancy is an important design factor. Hence, in the illustrated examples, the Seabob docking station 115 comprises a floor 280, which supports the water-based motorised device, such as a Seabob or stand up Jet ski. In some examples, a small floor 280 may be attached to the ballast bag with dump for any version of a standard Jet-Ski. In some examples, the floor 280 of the water-based motorised device docking station 115 is designed with a suitable amount of sag as per the Seabob design. Notably, in some examples, the floor 280 may not fill all of a gap created by the V-shaped or U-shaped inflatable tube. In some examples, the floor 280 may be designed to cover a part of the gap, thereby advantageously not affecting or interfering with any intake valve of the water-based motorised device when being docked. In some examples, the water-based motorised device docking station 115 may include various finish options to this floor design, for example: a) PVC™ layer with Teak foam finish as per known Nautibouy™ platforms; b) PVC™ layer with Nautibouy's™ Diamond finish, or c) PVC™ with multiple surfaces and colours. In accordance with some examples of the invention, the water-based motorised device docking station floor may be weighted down (e.g. with an approx. weight around 300 g), substantially around the central portion of the open-ended side to allow easy, water-based, access. In some examples, the floor 280 of the water-based motorised device docking station 115 may be made of a PVC with a grooved surface diamond finish, to facilitate the water-based motorised device sliding easier into the docking station 115 when wet.

In some examples, it is envisaged that a floor edge 222 of the floor 280 may be reinforced to avoid any risk of the floor ripping as the water-based motorised device enters the docking station 115. In some examples, it is envisaged that the floor edge 222 may also be reinforced where the (skirt) floor is attached to the underside of the tubes. Furthermore, in some examples related to the heavier water-based motorised device, such as a stand-up jet-ski, it is envisaged that a floor edge 222 may be reinforced at the edge by sewing a seam along the edge of the PVC non-skid area, to enable the water-based motorised device docking station 115 to still roll easily. Any suitable flexible means of reinforcing the floor edge 222 is also envisaged.

In some examples, it is also envisaged that weights may be located along the edge of the floor edge 222 too, in order to maintain a good shape of the floor edge to allow ease of entry, for example for a stand-up jet-ski docking station. It is also envisaged, in some examples, that weights might be positioned up the central line of the floor area, for a stand-up jet ski version (where the floor will be longer than for a Seabob) and may additionally be weighted down in other areas to allow the stand-up jet-ski to slide in easily. It is also envisaged in some examples, that weights might be positioned around the underside of the floor area in order to create the desired sag of the floor area. In this manner, the constructed sag of the floor area may allow a stand-up jet-ski to be driven in and then subsequently supported. In some examples, it is also envisaged that the floor area with ballast attached to it, may be either sewn and/or glued, and may then be glued to the underside of the inflatable tubes in order to take the weight of the ballast as well as support the water-based motorised device.

In some examples, air toggle loops 250 may be positioned at various locations around the water-based motorised device docking station 115. For example, in the illustration in FIG. 2, three air toggle loops 250 are positioned in place. It is envisaged that in other designs, a different number of air toggle loops 250 may be positioned in different locations, e.g. with say two air toggle loops 250 positioned on each side of the water-based motorised device docking station 115. In this example, a first air toggle loop 250 at the very front of the dock at the head of the V-shape or U-shaped inflatable. In other examples, the first air toggle loop 250 may be omitted, relocated or replaced at the very front of the docking station by a D-ring. In the illustration of FIG. 2, second and third air toggle loops 250 are positioned at either side of the V-shape or U-shaped inflatable water-based motorised device docking station 115. Although only two air-toggle loops are illustrated in the drawings, it is envisaged that more air-toggle loops may be used in practice, with only two shown for illustration purposes only.

In this example, three air toggle loops 250 are positioned in the allocated places to provide increased flexibility of linking multiple water-based motorised device docking stations 115 to the central platform and each other, with many possible positions and orientations. Although only three air-toggle loops are illustrated in the drawings, it is envisaged that more air-toggle loops may be used in practice, with only three shown for illustration purposes only.

It is envisaged that in other designs, more or fewer air toggle loops 250 may be positioned at locations around the water-based motorised device docking station 115. Furthermore, it is envisaged that in other designs, the air toggle loops 250 may be positioned at different locations around the water-based motorised device docking stations 115, e.g. a Seabob docking station, or a jet-ski docking station, dependent on the prevalent design considerations and what water-based motorised device the docking stations is designed to accommodate.

In some examples, air toggle loops 250 may be configured of a loop of fabric (for example, say, 25 mm wide and approximately 57 cm long). When not in use they may be held in place with a Velcro™ flap, for example about 8 cm in length. It is envisaged that in other designs, different securing mechanisms may be employed for the air toggle loops of the water-based motorised device docking station 115.

In some examples, air toggle loops 250 are configured such that, in use, the Velcro flap is released and the air toggle loops 250 may be pulled out, a deflated tube inserted then inflated, such that the loops fit round the inflated tube 110 of, say, 20 cm in diameter.

In some examples, the air toggle loops 250 are designed to facilitate a modular configuration of multiple water-based motorised device docking stations 115, as shown. In this manner, the multiple water-based motorised device docking stations 115 can be connected link to a central platform 105 with an air toggle linking system. One such air toggle linking system is described in Applicant's co-pending UK application (Application number GB 1417973.3), the contents of which is incorporated herewith in full. This co-pending application describes an arrangement whereby the coupling link can be manufactured and sold on its own, thereby allowing it to be retro-fit (for example by gluing) to existing inflatable structures, and thus may be purchased individually to protect each water-based motorised device purchased.

In some examples, the air toggle loop linking system works by releasing the air toggle loops 250 on the platform along with the air toggle loops 250 on the water-based motorised device docking stations 115, and thereafter inserting a separate deflated 20 cm buffering tube, through all of the released air toggle loops 250, then inflating the buffering tube for an entrapment free connection. As a comparable example, consider how a pin is used to secure a metal pipe in a door hinge.

In some examples, the air toggle loops 250 also enable the multiple water-based motorised device docking stations 115 to be connected together side by side to each other (for example a shown in FIG. 5 and a joining air toggle) without having to have a central platform 105, such as a Nauti- Buoy™ platform, to link to. In some examples, a separate linking air toggle (shown on each side of the platform, in FIG. 1, with four 4 air toggles or buffering tubes in total, to link all the docking stations to the central platform) may be used to connect the water-based motorised device docking station 115 to a central platform 105.

In some examples, multiple individual water-based motorised device docking stations, e.g. Seabob docking stations, and/or jet-ski docking stations may be linked, in a circle or star formation using one or more D-ring(s) located at or around the nose of the docking station, via a dock line fed through each of them, or by other means.

In some examples, an anchor point 260 may be positioned to an underside of the inflatable tube so the docking station can be fully anchored, to secure safe storage. In some examples, anchor point 260 may be configured from a suitable soft material to avoid damaging the boat or yacht when stowed away.

Figure 3:
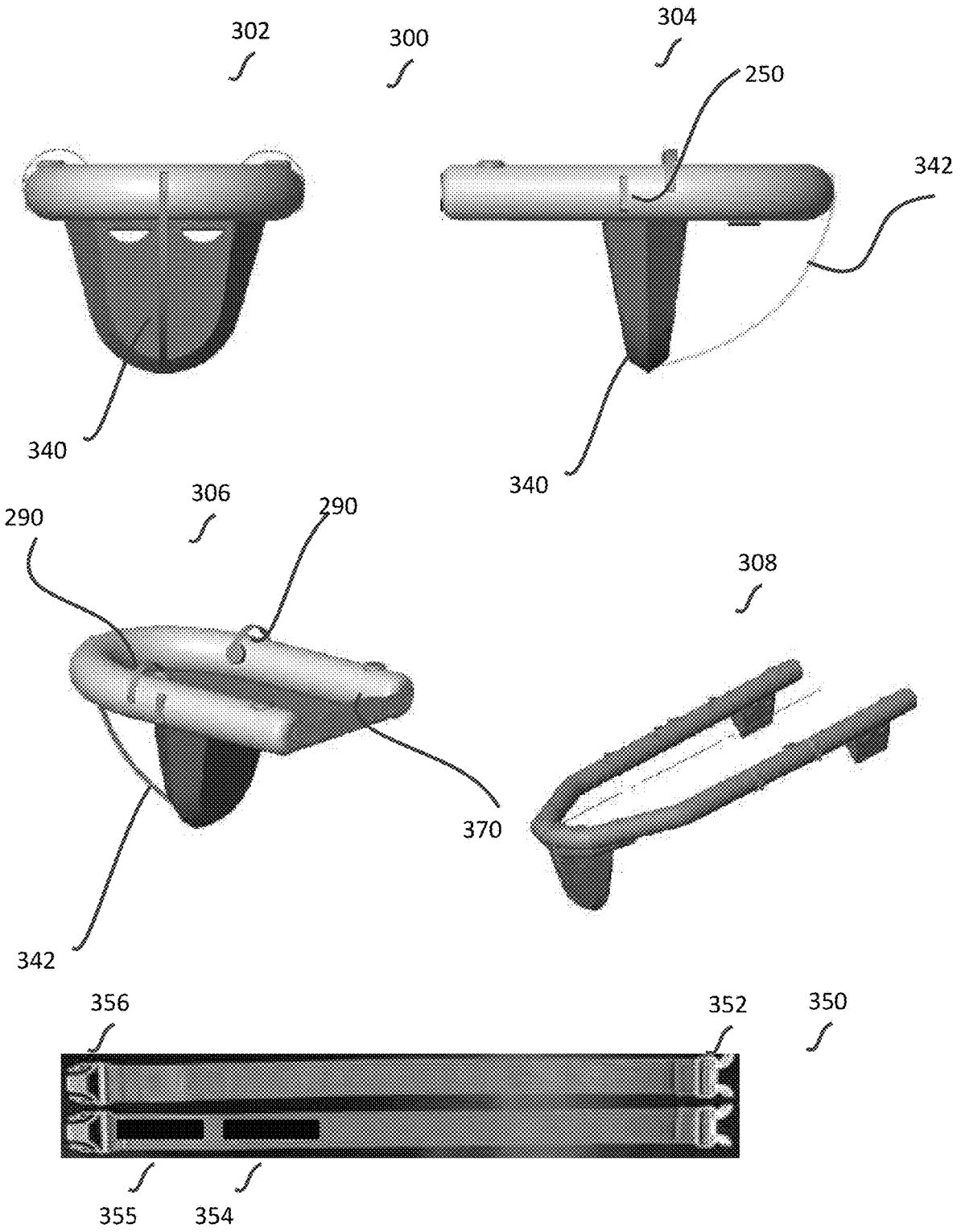
FIG. 3 illustrates an overview of further various views of an inflatable Seabob docking station with a ballast bag with dump in addition to one example of a connection strap to releasably connect a water-based motorised device to a inflatable water-based motorised device docking station, according to example embodiments of the present invention.

FIG. 3 illustrates further various views of an inflatable water-based motorised device docking station with a ballast and dump, according to example embodiments of the present invention. A first view 302 illustrates a front plan view of an inflatable water-based motorised device docking station 115. A second view 304 illustrates a side plan view of an inflatable water-based motorised device docking station 115. A third view 306 illustrates a further view of an inflatable water-based motorised device docking station 115. A fourth view 308 illustrates a further view of an inflatable water-based motorised device docking station 115, where there is a small floor area enough to support the ballast bag with dump enclosed by the inflatable tube, such that inflatable water-based motorised device docking station 115 is suitable to receive a standard jet-ski.

Advantageously, in some example embodiments, the ballast bag 340 with dump may be configured to hold a substantial amount of water, e.g. 40 litres, and configured to fill automatically when in located in a vertical down position. In this manner, the ballast bag 340 with dump is configured, when full of water, to keep the water-based motorised device docking station 115 stable in the water when the water-based motorised device is entering and exiting the dock and stop the docking station swinging around in the breeze when either in use, or not. Furthermore, the ballast bag with dump prevents the water-based motorised device docking station 115 from flipping/blowing over in winds too.

In some examples, the ballast bag with dump 340 may be locatable in position via a ballast bag strap 342, such that it may be kept in place in the vertical down position with a suitable material, at the top of the strap and where it meets the water-based motorised device docking station 115. Alternatively, in some examples, the ballast bag (with dump arrangement) does not need the strap to keep it in a vertical down position, as it fills automatically. The dump strap 342 makes the dumping easy. In some examples, the ballast bag with dump may be either glued or stitched to the floor. The Ballast bag part is glued and/or stitched to the floor, with the end of the dump strap 342 being attached to the inflatable tube 110.

In some examples, a dump system is provided to facilitate water being removed in one movement from the ballast bag 340 with manual dump system. In some examples the dump system may be configured by pulling up the dump strap 342 and the dump strap 342 re-applied with a lower piece of Velcro™ to connect both the dump strap 342 and the docking station 115. This holds the dump in the up position before removing the water-based motorised docking station 115 easily from the water. For example, for a Seabob™ water-based motorised device, a single ballast bag is located in a central position, and the dump strap 342 is pulled up by the user and the water based motorised docking device is lifted by a tethering D-ring at the nose (or mid-point) of the water-based motorised device docking station 115 and this action lifts the water-based motorised device docking station 115 out of the water whilst expelling all the water from the ballast.

Alternatively, as illustrated in 308, for example for a standard jet ski or stand-up jet ski water-based motorised device, two small ballast bags may be located at a rear of the tubes, either side in order to keep the docking station down and avoid the tubes lifting in the wind. In some examples, this design may not employ a dump arrangement. Again, when the dump strap 342 at the nose is pulled up, this action expels all the water of the front ballast and the back ones then drain easily as they have small drainage holes cut into them at the bottom (not shown).

In some examples, a rear containment strap 370 is included, positioned at the rear of the Seabob docking station 115 and used to secure the Seabob when not in use to ensure that the Seabob doesn't float away. In some examples, the rear containment strap 370 is configured to be quick to release and attach for ease of use and remain open when the Seabob is in use so that it is easy to drive the Seabob back in to the Seabob docking station 115.

It is known that a Seabob has a hole on the top in the rear half section, which is used to attach one or more accessory, such as a Seabob pilot belt. In some examples, it is envisaged that this same attachment at the end of the seabob pilot belt may be used to attach to a strap (e.g. a retractable strap) that is situated on the water-based motorised device docking station 115.

In other examples it is envisaged that the handles 290 may include a PVC™ strap with a D-Ring end. The PVC™ strap may be glued down to the surface of the water based motorised device docking station 115. In some examples the final 4-6 cm of the PVC™ strap with the D-Ring is not glued down. In this manner, it has the flexibility of movement: both forward and backwards. In some examples, it may also be reinforced underneath, in order to allow strength of force in both a forward and backward direction. In some examples, the handle may comprise a webbing connection strap with a buckle that is coupled through the D-Ring, and secured back on to itself with Velcro™, as illustrated as second strap at 350.

Here, two small strips of Velcro™ 354, 355 are attached (e.g. sewn) to a webbing strip of the second strap 350. In one example, typical dimensions could be webbing of 68 cm in length, with 38 mm wide, with a folding over near the buckle of, say, 3 cm. The two small strips of Velcro™ 354, 355 are each 8 cm long, with a gap of 2 cm there between and used to form a first loop. The first strip of Velcro™ 354 may be located 1 cm from the male part of the buckle 356 as shown, or the female part of the buckle 352 in other examples.

In use, the two small strips of Velcro™ 354, 355 secure onto each other over a D-ring on the end of PVC strap of handle 290. This means that the bottom part of the strap is still long enough to release and go through the Seabob™ docking station handle with the female part of the buckle 352 attached on the end. The strips of Velcro™ 354, 355 enable the male part of the buckle 356 to hang down lower than if it was attached directly at the D-ring, which means the bottom part of webbing can be shorter and therefore does not become stuck in the jet intake valve of the Seabob™ when it is left loose and the Seabob™ drives into the docking station.

Thus, this arrangement solved a number of problems, such as identifying a securing mechanism (e.g. a piece of webbing) that was long enough to traverse through a Seabob™ handle and secure back up to itself into the buckle, when the buckle was undone in between uses. More importantly, the securing mechanism is configured such that it cannot be sucked into the jet intake valve of the Seabob™. The buckle and webbing system for connection has been chosen as it is strong enough and secure enough to take the weight of the Seabob™, which is an expensive piece of equipment that cannot afford to be lost.

In some examples, and with regard to attaching larger and heavier jet-skis to their respective water-based motorised device docking station 115, it is envisaged that many D-Rings may be employed around the water-based motorised device docking station 115. For example, in one design, five D-rings are located around the top of the water-based motorised device docking station 115 to secure whichever water-based motorised device is attached. For example, one D-Ring may be located at a mid-point at the interior nose, two located substantially around a mid-point (half-way down the cut out) and two towards the rear of the open end. In this manner, the water-based motorised device docking station 115 can be configured to be coupled to standard water-based motorised device, such as a standard jet-ski that has a metal D-Ring underneath their nose at the front and another D-ring towards the rear close to the back of the seat or a stand-up jet ski that has D-rings on their outer side edges. Examples of some D-ring configurations are illustrated in the stand up jet-ski version in 450 in FIG. 4.

Figure 4:
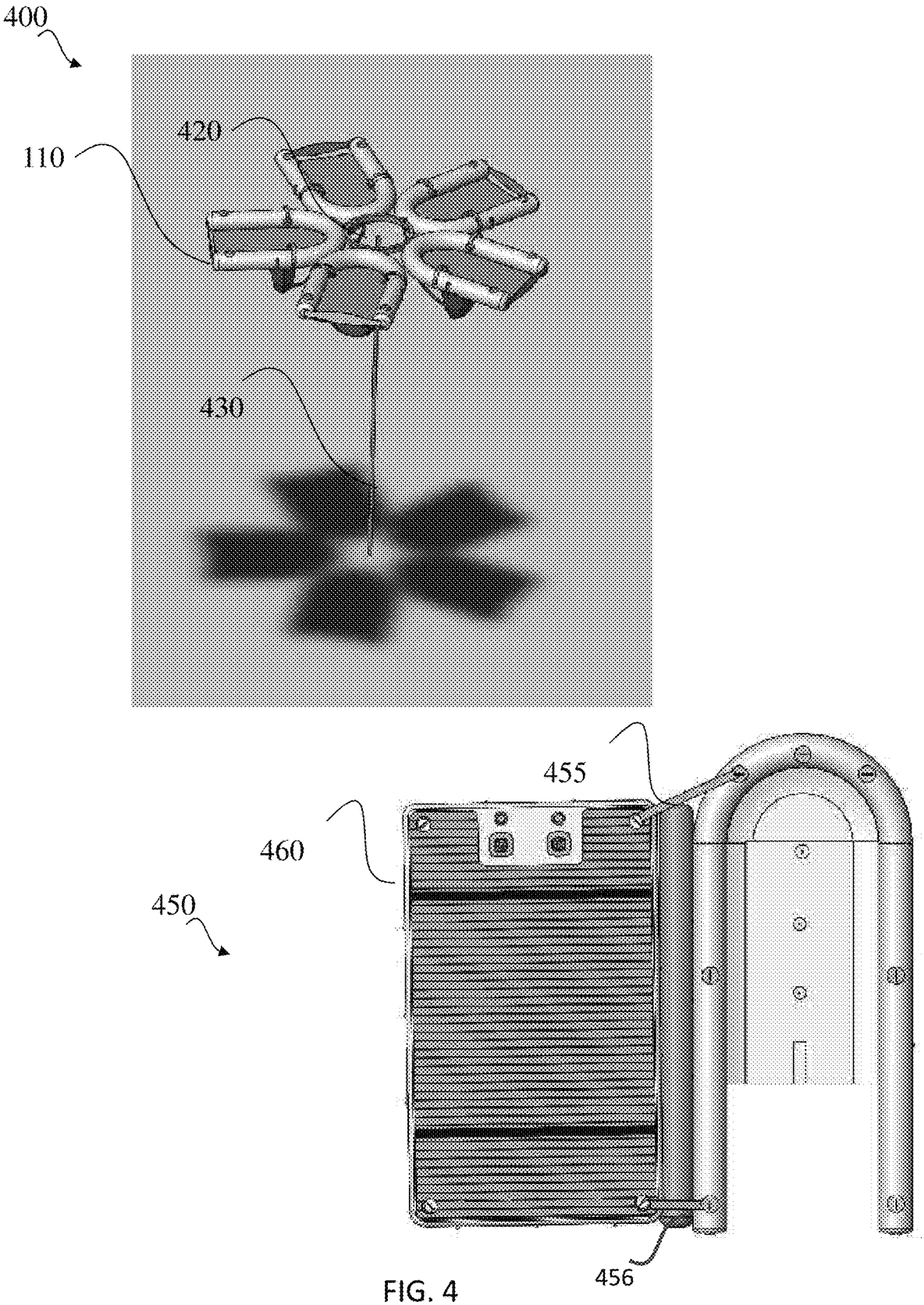
FIG. 4 illustrates an example of a Seabob anchor ring assembly, according to a second example embodiment of the present invention, as well as one example of a stand up jet-ski dock attached to a platform.

Referring now to FIG. 4 an example of a water-based motorised device anchor ring assembly 400 is illustrated, according to a further example embodiment of the present invention. Multiple water-based motorised device docking stations 115 are attached to a water-based motorised device anchor ring 420 that may be anchored to a sea bed via an anchor line 430. The multiple water-based motorised device docking stations 115 may be connected to the water-based motorised device anchor ring assembly 400 via a front D-Ring, thereby forming a star-shape formation as illustrated. This configuration is useful for the lighter Seabob water-based motorised device docking stations 115.

Furthermore, in other examples, it is envisaged that one or more secondary connections 455, 456 (e.g. using a connection webbing strap with buckle) to either a platform 460 or each other D-Ring to D-ring, are envisaged, in case of a potential air toggle failure (due to deflation of the inflatable tube, for example. The secondary connections 455, 456 may be employed when the water-based motorised device docking stations 115 are either linked to a platform 460 (as shown) or linked to each other. In some examples, the D-rings may link to each other with the secondary connections 455, 456 of a connection webbing strap, with buckle system when the docking stations 115 are located side by side. In some examples, for water-based motorised device docking stations 115 for heavier water-based motorised devices, such as jet-skis, it is envisaged that such secondary connections 455, 456 may be particularly useful, so long as each water-based motorised device docking stations 115 is secured to a structure platform/yacht individually.

Thus, examples of the invention provide a number of novel and advantageous features that enhance an inflatable central platform 105, such as the Applicant's NautiBuoy™ Marine Platform. Examples of the invention provide a stable, simple to manoeuvre and easy to install water-based motorised device docking station 115, one or more of which can be readily connected to the inflatable central platform 105 or to one another. Furthermore, the examples herein described ensure that the water-based motorised device docking stations 115 are easy to install and/or lift from the water.

Figure 5:
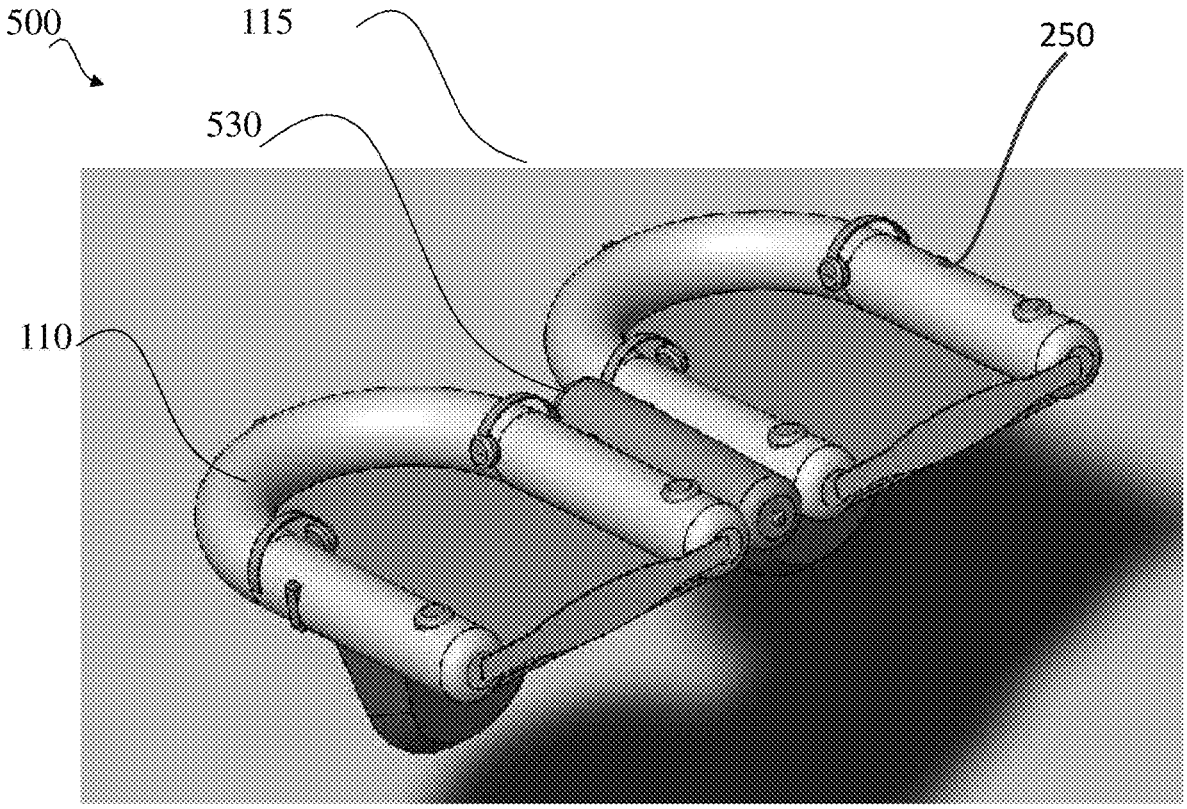
FIG. 5 illustrates a first example view of an arrangement to connect multiple inflatable Seabob docking stations, according to example embodiments of the present invention.

FIG. 5 illustrates a first example view 500 of an arrangement to connect multiple inflatable water-based motorised device docking stations, according to example embodiments of the present invention. In this example, three air toggle loops 250 are positioned in the allocated places to provide increased flexibility of linking multiple water-based motorised device docking stations 115 to the central platform and/or each other, with many possible positions and orientations.

In FIG. 5, the respective multiple inflatable water-based motorised device docking stations may be connected to one another via an air toggle linking system whereby air toggle loops 250 located on the side of the V-shape or U-shaped inflatable water-based motorised device docking station 115 are connected together. In this first illustrated example, an inflatable buffering tube 530, sometimes referred to as an 'air toggle', may be locatable between the respective sides of the V-shape or U-shaped inflatable water-based motorised device docking station 115. Here, the buffering tube (e.g. air toggle) 530 is secured by releasing one air toggle loop from either side of each docking station 115, inserting a deflated buffering tube 530 and then inflate the buffering tube to secure the modular arrangement.

In an alternative example (not shown), the connections of the respective sides of the V-shape or U-shaped inflatable water-based motorised device docking stations 115 may be connected directly, e.g. without an inflatable buffering tube 530. Here, for example with a Seabob™ docking station where the floor area traverses along half of the inflatable tube, portions of the inflatable tube that are not adjacent the floor area may be connected using air toggle loops. For example, a left leg of a first water-based motorised device docking station 115 may be directly connected with a right leg of a second water-based motorised device docking station 115, using one or more air toggle loop(s), for example by inserting respective deflated legs and then inflating the legs to secure the two water-based motorised device docking stations in a modular arrangement.

Figure 6:
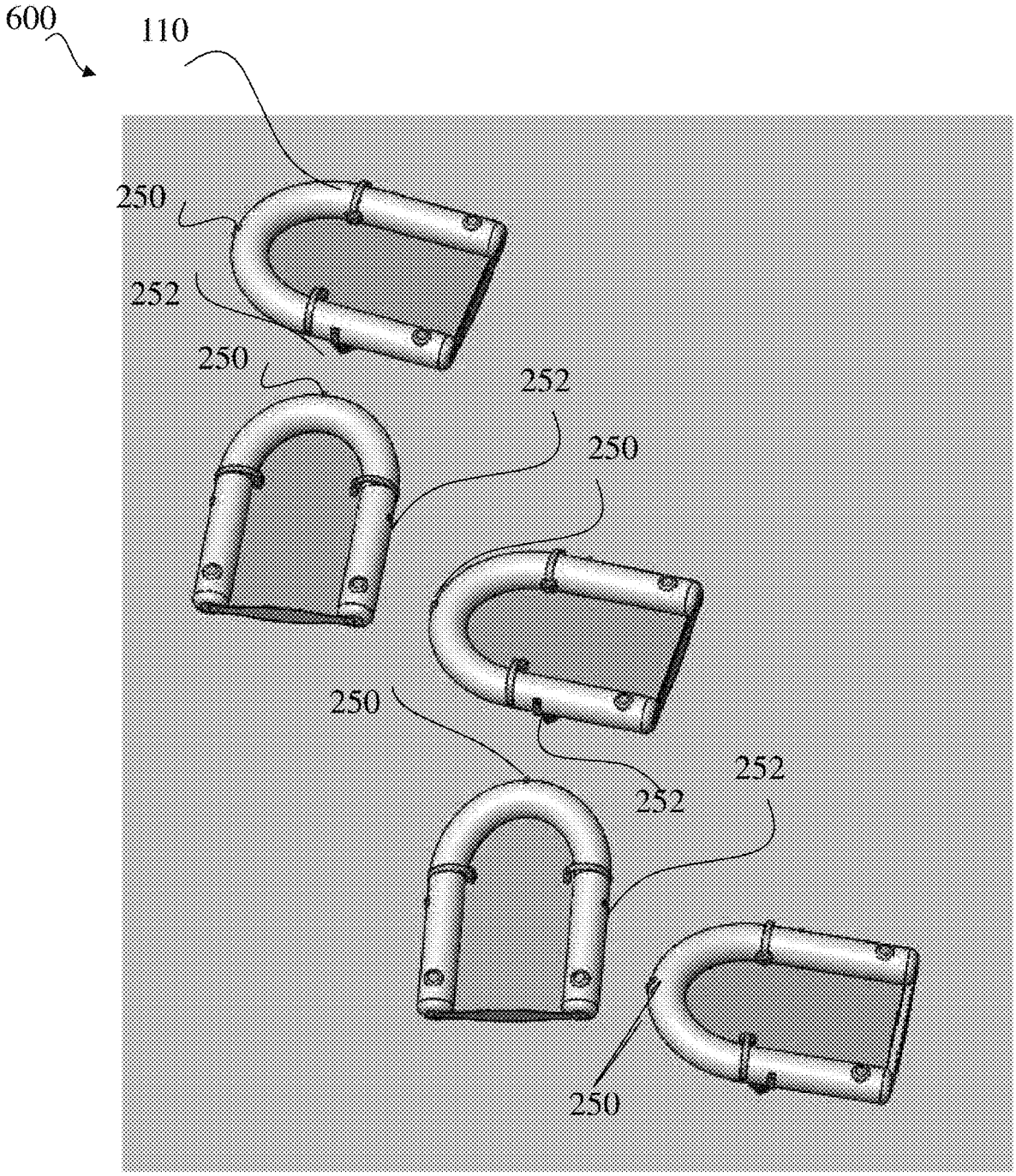
FIG. 6 illustrates a second example view of an arrangement to connect multiple inflatable Seabob docking stations, according to example embodiments of the present invention.

FIG. 6 illustrates a second example view 600 of an arrangement to connect multiple inflatable water-based motorised device docking stations, according to example embodiments of the present invention. In this second example, multiple inflatable water-based motorised device docking stations may be connected in a herring bone arrangement. For example, a first front D-ring at the very front of the dock at the head of the V-shape or U-shaped inflatable is connected to one second air toggle loop 252 located at one of the sides of the next inflatable water-based motorised device docking station in a chain. With multiple V-shape or U-shaped inflatable water-based motorised device docking stations 115, with alternate left hand and right hand side air toggle loops 252, a herring bone arrangement may be formed. Alternatively, the herringbone formation may be formed by a long line in the water and secured by the D-ring at the nose to various points on the dockline in the water, for example for a jet-ski docking station.

In some examples, it is envisaged that the components herein before described with respect to a single or multiple inflatable water-based motorised device docking station(s)

115 may be sold as a kit of parts, e.g. configurable tube 110, floor 280, air toggle loops 252, rear containment strap 370, etc.

Figure 7:
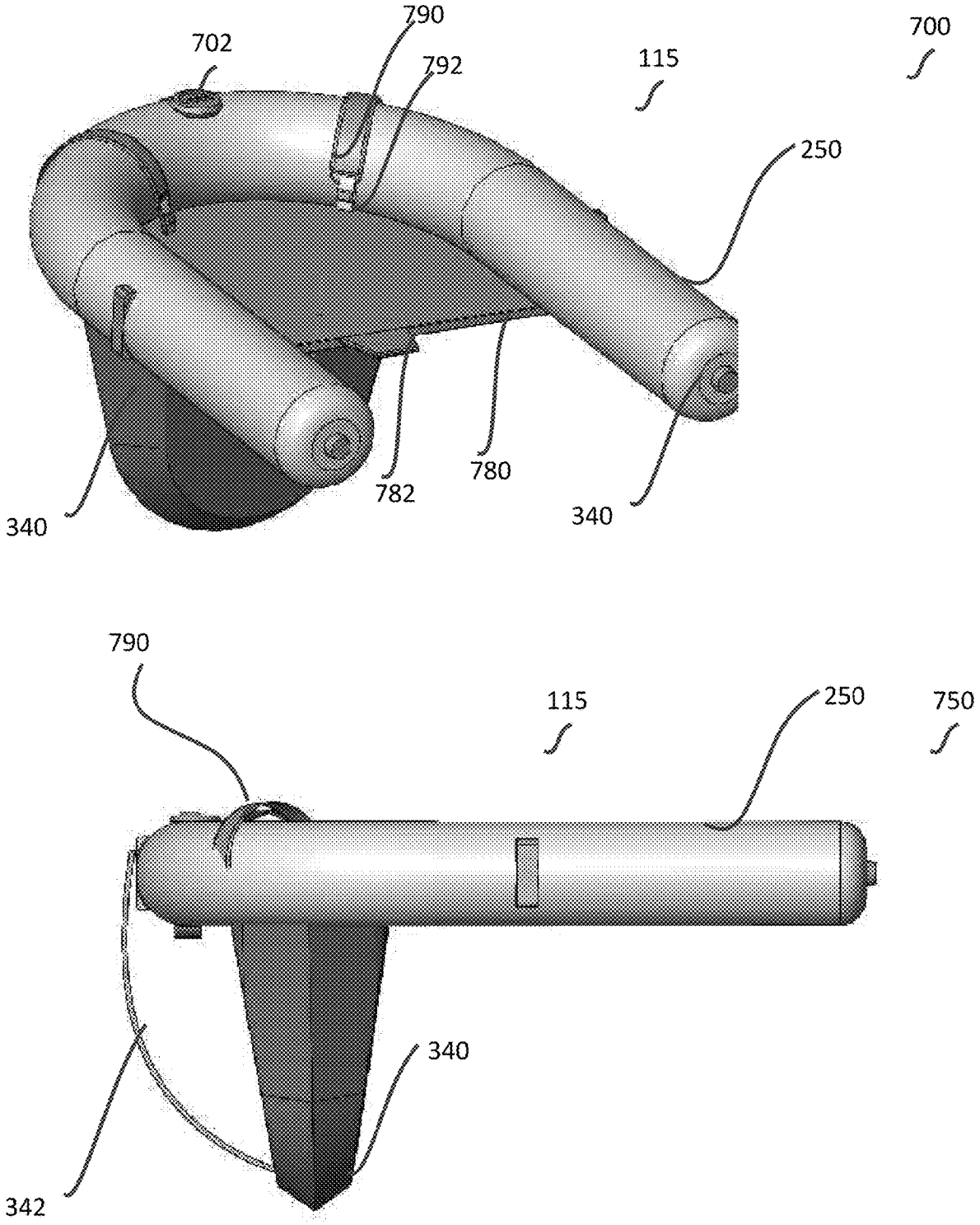
FIG. 7 illustrates an overview of various views of an inflatable Seabob docking station according to example embodiments of the present invention.

FIG. 7 illustrates a view of an inflatable water-based motorised device docking station with a ballast bag with dump, according to example embodiments of the present invention. A first view 700 illustrates a 3-dimension view of an inflatable water-based motorised device docking station 115. A second view 750 illustrates a side plan view of the inflatable water-based motorised device docking station 115.

In the same manner as FIG. 3, this example includes a ballast bag 340 with dump arrangement that, when full of water, is configured to keep the water-based motorised device docking station 115 stable in the water, for example when the water-based motorised device is entering and exiting the dock and stop the docking station swinging around in the breeze when either in use, or not. Furthermore, the ballast bag prevents the water-based motorised device docking station 115 from flipping/blowing over in winds too.

In this example, the ballast bag 340 may be locatable in position via a dump strap 342, such that it may be kept in place in the vertical down position with a suitable material, at the top of the dump strap 342 and where it meets the water-based motorised device docking station 115. Alternatively, in some examples, the ballast bag (with dump arrangement) does not need the dump strap 342 to keep it in a vertical down position, as it fills automatically. The dump strap 342 makes the dumping easy. In some examples, the ballast bag with dump may be either glued or stitched to the floor. The Ballast bag part may be glued and/or stitched to the floor, and the end of the dump strap 342 may be attached to the inflatable tube 110. In some examples, it is also envisaged that the floor area with ballast attached to it, may then be glued to the underside of the inflatable tubes in order to take the weight of the ballast as well as support the water-based motorised device.

In some examples, a dump system is provided to facilitate water being removed in one movement from the ballast bag 340 with manual dump system. In this example, the dump strap 342 is permanently secured at the nose of the inflatable tube 250, so as not to get stuck in a jet intake valve of the water-based motorised device. Advantageously, the user is able to pull the dump strap 342 easily, in order to eject all of the water in the dump as well as allowing the docking station to be lifted by the tethering D-ring in order to remove the water-based motorised device docking station from the water.

In some examples the dump system may be configured by pulling up the dump strap 342 and the dump strap 342 re-applied with a lower piece of Velcro™ on both the dump strap 342 and the docking station 115, in order to hold the dump in the up position before removing the water-based motorised docking station 115 easily from the water. Here, the dump strap 342 is pulled up by the user at the nose (or mid-point) of the water-based motorised device docking station 115, expelling all the water from the ballast. The Velcro™ of the dump strap 342 is secured to the Velcro™ attached to the docking station, in order to hold the ballast in the up position. The water-based motorised device docking station 115 is then lifted out of the water by the user, by the tethering D-ring at the nose.

In this example, the floor area 780 is configured such that it is surrounded by only a portion of the inflatable tube 250. In this manner, the intake valve of the water-based motorised device is located distant from some of the components on the docking station 115. Also, in this example floor area 780 includes a weighting element 782 arranged to weigh down the floor area 780, for example from a substantially central location, thereby allowing easy access to the floor area from the water, and allowing easy removal to the water from the floor area 780 of the water-based motorised device. In some examples, weighting element 782 may be located on the underside of the floor area 780, near the floor edge (and not protruding). It is also envisaged, in some examples, that weights might be positioned up the central line of the floor area, for a stand up jet ski version (where the floor will be longer than for a Seabob) and may additionally be weighted down in other areas to allow the stand-up jet-ski to slide in easily. It is also envisaged in some examples, that weights might be positioned around the underside of the floor area in order to create the desired sag of the floor area. In this manner, the constructed sag of the floor area may allow a stand-up jet-ski to be driven in and then subsequently supported. In some examples, the weighting element 782 may be of the order of approx. 300 g in weight, and configured such that it can be kept in a PVC pocket on the underside of the floor area 780, for example in order to prevent rusting of the weight.

In some examples, a hole is inserted into the floor area, for example ⅔rds of the way up the internal floor area in the central line. This example employs a hole to avoid air forming under the floor where the ballast bag is attached and pushing the floor area upwards with air pockets at the rear. The hole therefore allows that air to escape and water to sink in over and under the floor area. A typical dimension of a hole would be approx. 1 cm wide. Although this example describes a single 'air pocket hole' it is envisaged that, in other examples, multiple holes may be located in the skirt to release air pockets, if required.

Figure 8:
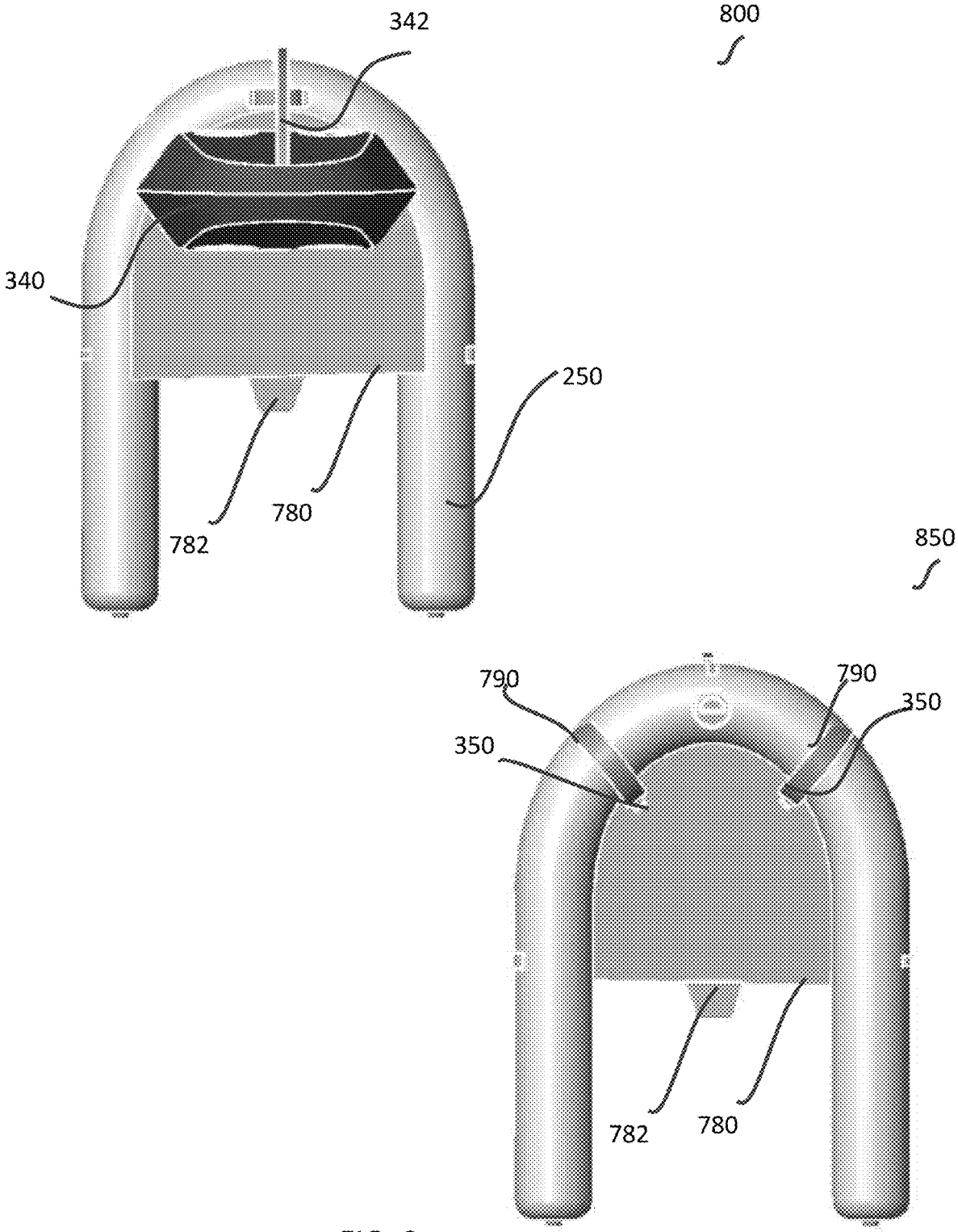
FIG. 8 illustrates an overview of further various views of an inflatable Seabob docking station with a ballast bag with dump, according to example embodiments of the present invention.

In some examples, the floor area 780 is configured to be approximately half of the area that could be used to close off the open-ended portions of the inflatable tube 250, in order to ensure that the jet intake valve of the water-based motorised device remains free. In other examples, this floor area may be of the order of 50-70% that may be used to close off the open-ended portions of the inflatable tube 250. Thus, in some examples, the floor area 780 may include at least a portion that is substantially surrounded by the inflatable tube, for stand-up jet-skis or Seabobs™. In some examples, this (at least a portion) may be one from a group of: the floor area being wholly surrounded by the inflatable tube up to respective ends of the inflatable tube (as illustrated in FIGS. 1-6), a majority of the floor area being surrounded by the inflatable tube, the floor area encompassing approximately half of an axial length along each side of a V-shaped or U-shaped inflatable tube (as illustrated in FIG. 7 and FIG. 8. In some examples, the floor area for the stand up jet-ski may be configured to be approx. ⅔rds of a length along both sides of the V-shaped or U-shaped inflatable tube.

In some examples, the floor area 780 may be made of a PVC material with a pattern to it, as a regular PVC has been found to be too sticky to allow the water-based motorised device to easily slide into and out of the water-based motorised device docking station 115.

In this example, handle containment straps 790 include D-ring ends. The D-ring ends may include removable and replaceable connection second straps 350 having buckles 352, 356 on the end, as per drawing 350 on FIG. 3, for example to connect to the water-based motorised device when located on the water-based motorised device docking station 115. In this manner, the water-based motorised device may be secured in place within the water-based motorised device docking station 115 when not in use, and easily releasable by a user located in the water when required for use, or easily connected to the water-based motorised device after the user drives up onto the floor 780.

FIG. 8 illustrates a further overview of further various views of an inflatable Seabob docking station with a ballast and dump arrangements, according to example embodiments of the present invention. In the same manner as FIG. 7, this example includes handle containment straps 790 that include D-ring ends. The D-ring ends may include removable and replaceable connection straps 350 having buckles 352, 356 on the end, as per drawing 350 on FIG. 3, for example to connect to the water-based motorised device when located on the water-based motorised device docking station 115. The webbing with buckle is then connected to the D-ring by folding the webbing over the D-ring and securing back onto itself by two small strips of Velcro, for example of length approximately 8 cm-10 cm to avoid the straps being so lengthy to interfere with the operation of the water-based motorised device, e.g. a jet intake valve of the device. Advantageously, the buckle may be easily released to remove the water-based motorised device, or easily connected feeding the webbing with the female buckle on the end, through the handle of the water-based motorised device, and back up to connect the male buckle near the D-Ring. In this manner, an easily connectable/disconnectable water level, drive in-drive out solution is provided. Additionally, the particular configuration of the webbing with the buckle, as connected to the D-ring, is also strong and secure.

Figure 9:
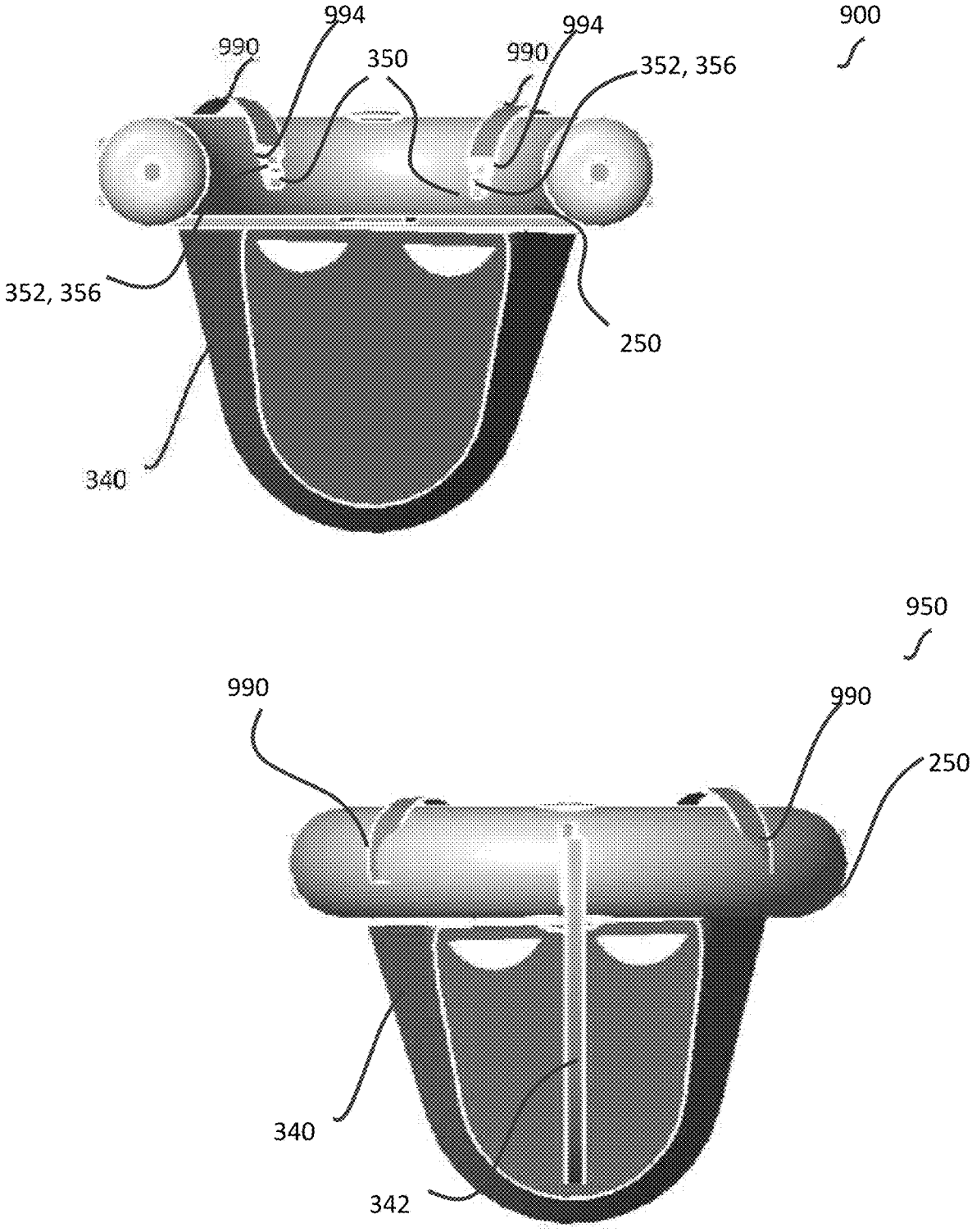
FIG. 9 illustrates an example of further various views of an inflatable docking station with a ballast bag with dump, according to an example embodiment of the present invention.

FIG. 9 illustrates an example of further various views 900, 950 of an inflatable docking station with a ballast bag with dump arrangement, according to example embodiments of the present invention. Here, the inflatable water-based motorised device docking station 115 includes: an inflatable tube 250 configurable to form an open ended area to receive a water-based motorised device. In this example it is envisaged that the handles may include a first PVC™ strap 990 with a D-Ring end 994. The first PVC™ strap may be glued down to the surface of the water based motorised device docking station 115. In some examples the final 4-6 cm of the first PVC™ strap 990 with the D-Ring end 994 is not glued down. In this manner, it has the flexibility of movement: both forward and backwards. In some examples, it may also be reinforced underneath, in order to allow strength of force in both a forward and backward direction. In some examples, the handle may comprise a webbing connection strap with male and female parts of a buckle 352, 356 that is coupled through the D-Ring, and secured back on to itself with Velcro™, as illustrated as second strap at 350.

In use, the two small strips of Velcro™ secure onto each other over a D-ring on the end of PVC strap of handle. This means that the bottom part of the strap is still long enough to release and go through the Seabob™ docking station handle with the female part of the buckle 352 attached on the end. The strips of Velcro™ enable the male part of the buckle 356 to hang down lower than if it was attached directly at the D-ring, which means the bottom part of webbing can be shorter and therefore does not become stuck in the jet intake valve of the Seabob™ when it is left loose and the Seabob™ drives into the docking station In other examples, buckle may be additionally connected to a length adjustable, self-attaching, strip to loop around a fixing point of an inflatable water-based motorised device when located in the inflatable water-based motorised device docking station. In this manner, the length adjustable, self-attaching, strip, which in some examples is a Velcro strip, may be used to secure or remove the inflatable water-based motorised device from the inflatable water-based motorised device docking station 115.

The length adjustable, self-attaching, strip may be of a length sufficient to attach and fixedly locate the inflatable water-based motorised device when located in the inflatable water-based motorised device docking station and insufficient to interfere with a propulsion element, e.g. a jet intake valve of the water-based motorised device when in motion and removed from the inflatable water-based motorised device docking station.

Although examples of the length adjustable, self-attaching, strip (e.g. a Velcro™ strip has been described with reference to being connected to a second strip via a buckle, and thereafter a first strip via a D-ring, it is envisaged that other connections may be used in other examples.

Figure 10:
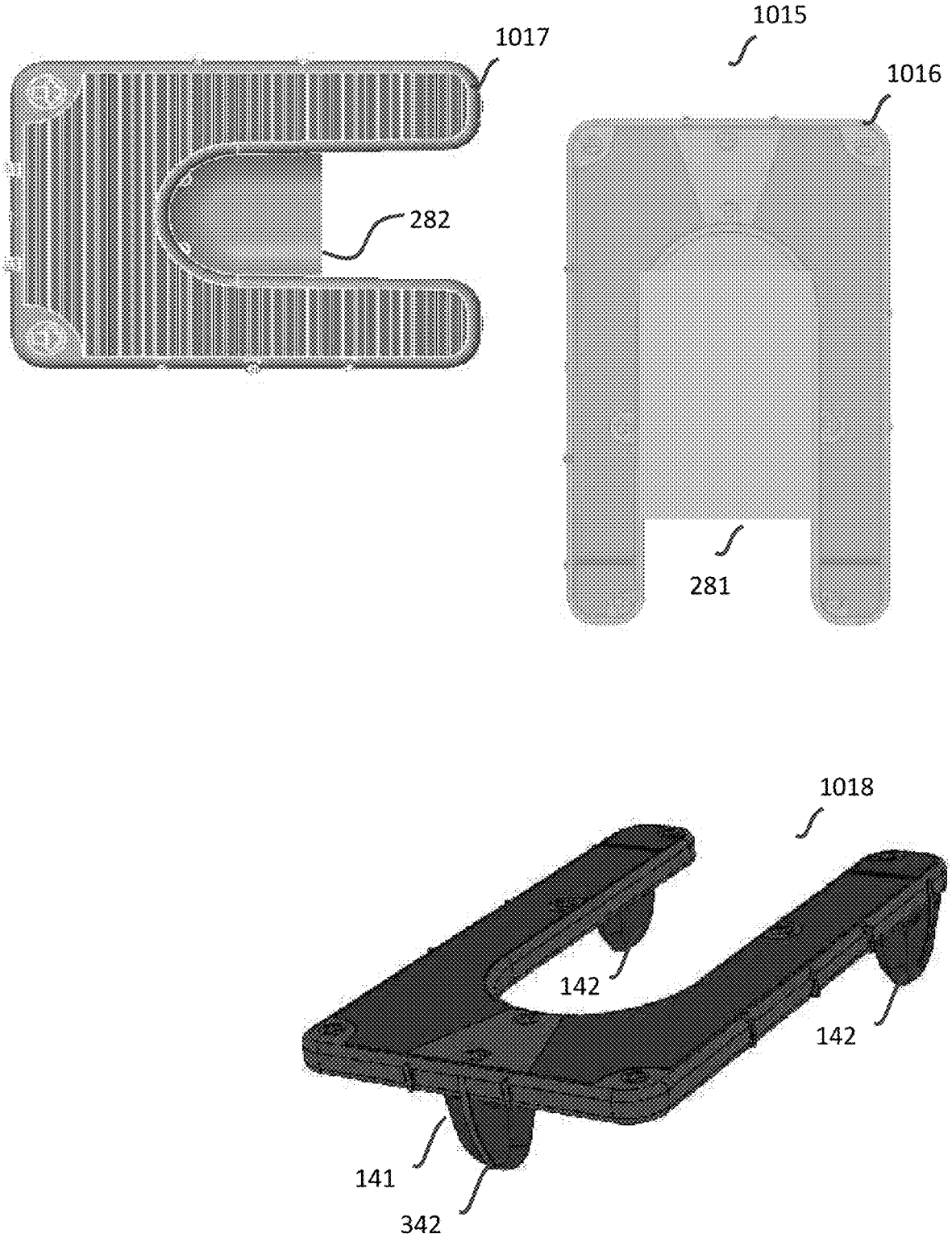
FIG. 10 illustrates an overview of various views of individual U-shaped platform designs with an optional ballast bag with dump arrangement according to example embodiments of the present invention.

FIG. 10 illustrates an overview of various views of individual U-shaped platform docking designs 1015 with an optional ballast bag with dump arrangement, according to example embodiments of the present invention. Here, as illustrated, the individual U-shaped platform docking station designs 1015 may include various area designs for the floor, for supporting a variety of water-based motorised devices, such as a Seabob or stand-up jet-skis.

For example, as illustrated in individual U-shaped platform docking station 1016 for, say, a stand up jet-ski design, the floor area 281 may be approximate ⅔rds of the open U-Shape, whereby, the floor area 281 of the platform, is designed to support the jet-ski in place and still be positioned forward of the jet-intake valve of the stand-up jet-ski usually located in the rear $\frac{1}{3}^{rd}$ underside of most stand up jet ski designs. The ballast bag with dump arrangement located in the centre point does not hang on to the floor area of 1016, as it attaches further forward under the dropstitch surround.

In some examples, such as second individual U-shaped platform docking station 1017 for, say, a Seabob, a smaller floor 282 is shown. However, in some examples, such as third individual U-shaped platform docking station 1018 for, say, a standard jet-ski, a floor area may be avoided. Here, one or more ballast bags 141, 142 may be attached to the underside of the platform. In some examples, the one or more ballast bags 141, 142 may be attached to an underside of a drop-stitch surround arrangement, as shown. In some examples of the invention, the drop-stitch material may be manufactured from, say, thousands of polyester threads that are extremely closely packed such that they maintain a surface that is strong enough to stand on. In the third illustrated example, the ballast bag with dump arrangement. The Velcro is positioned on the top of the platform 1018 in order to secure the dump strap 342 to it when dumping. This is particularly useful when there is more than one ballast bag to dump. Here, the Velcro™ holds each ballast bag in the up position so that it doesn't refill and allows easy removal of the platform docking station from the water.

A third illustrated example of a water-based motorised device docking station platform 1018 with minimal or no (internal) floor area is illustrated, where the minimal-floor or non-floor based implementation examples enable a standard jet-ski to be stowed. Here, as with other platform-based designs, three ballast bags with dump arrangement may be used, as illustrated in 1018, with a Velcro™ strip attached to the top of the water-based motorised device docking stations 1018. This ensures that the ballast bag stays up and therefore cannot refill when removing the water-based motorised device docking stations 115 from the water.

In some examples, as illustrated in 1018, the end of the ballast bag dump strap 342 may be attached to the side of the water-based motorised device docking stations 115 in order to avoid it going into the jet-intake). In this design, two ballast bags 142 with dump may be located on the ends of the legs of the water-based motorised device docking station platform, with one ballast bag 141 with dump arrangement located in the centre point. Here the dump system may be configured by pulling up the ballast bag dump strap 342 and re-applied using the lower piece of Velcro on the dump strap 342 and the Velcro on the water-based motorised device docking station in order to hold the dump in the up position before removing the platform docking station from the water. In alternative examples, the Velcro™ on the water-based motorised device docking station may be positioned to either the top or the sides of the water-based motorised device docking station.

The individual U-shaped platform concept enables a water-based motorised device user to be easily able to climb on and climb off the water-based motorised device in a controlled manner.

In some examples, the individual U-shaped platform docking stations 1015 for a water-based motorised device may include various finish options to the platform and/or floor design, for example: a) PVC™ layer with Teak foam finish as per known Nautibouy™ platforms; b) PVC™ layer with Nautibouy'S™ Diamond finish; or c) PVC™ with multiple surfaces and colours; or d) other variants of a foam finish (e.g. different colours or line markings.

Figure 11:
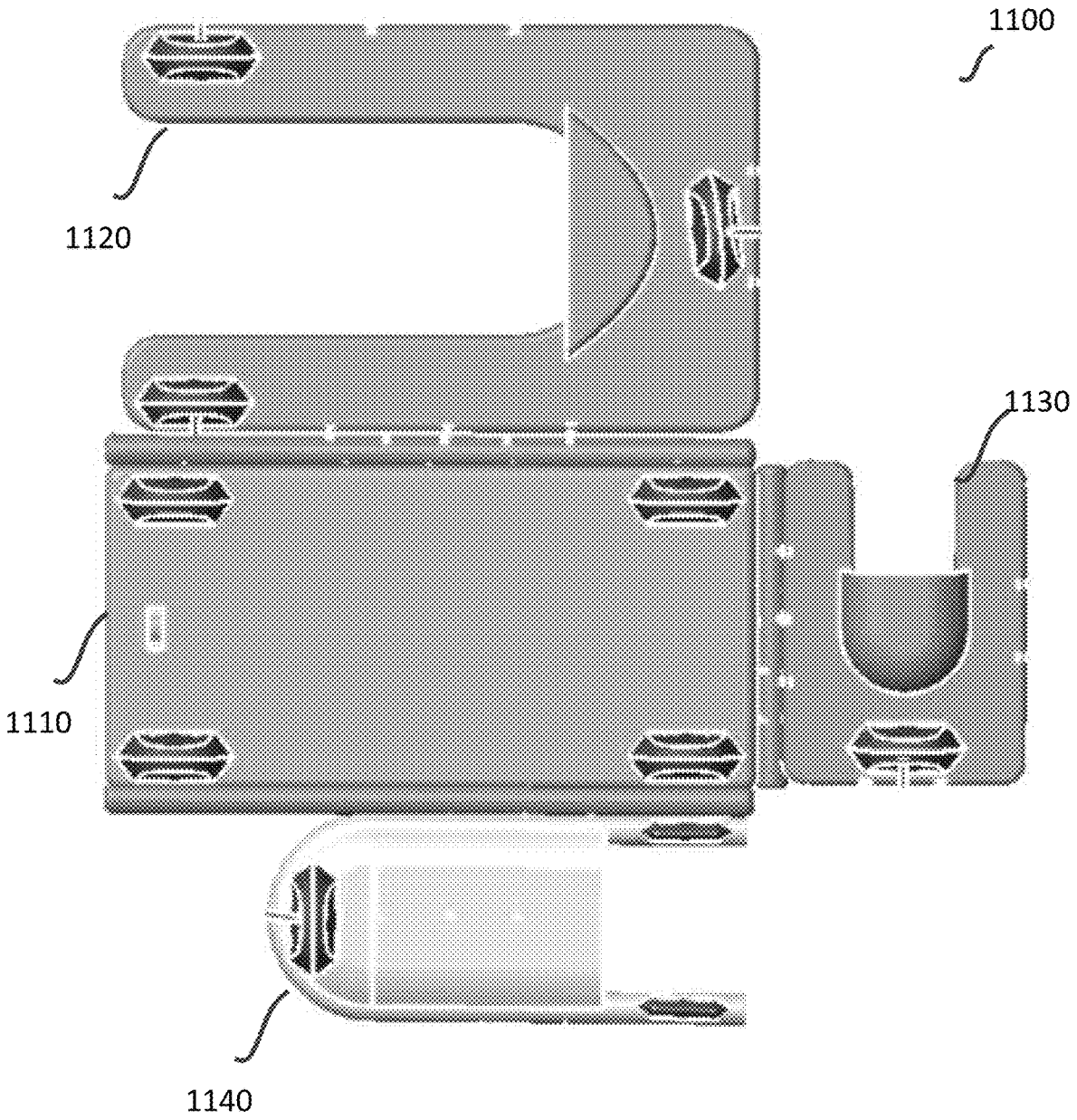
FIG. 11 illustrates one example of an overview (from underneath) of a platform coupled to various individual U-shaped platform designs with ballast bag with dump arrangements, configured to accommodate one each of: a Seabob™ and a jet-ski and a stand up jet-ski, according to example embodiments of the present invention.

FIG. 11 illustrates one example of an overview 1100 (from underneath) of a platform 1110 coupled to various individual U-shaped platform designs with ballast bag with dump arrangements, according to example embodiments of the present invention. In this example, a first individual U-shaped platform docking stations 1120 is configured to accommodate a jet-ski. A second individual U-shaped platform docking stations 1130 is configured to accommodate a Seabob™. A third individual U-shaped inflatable tube docking station 1140 is configured to accommodate a stand up jet-ski. As indicated previously, the U-shaped arrangements for any of the water-based motorised devices may be formed as either an inflatable tube docking station or a U-shaped platform docking station.

In the forgoing specification, an invention has been described with reference to specific illustrated examples. It will, however, be evident that various modifications and changes may be made therein without departing from the scope of the invention as set forth in the appended claims.

The connections as discussed herein may be any type of connections suitable to transfer signals from or to the respective nodes, units or devices, for example via intermediary components. Accordingly, unless implied or stated otherwise, the connections may for example be direct connections or indirect connections. The connections may be illustrated or described in reference to being a single connection, a plurality of connections, unidirectional connections or bidirectional connections and connected in any suitable mechanical form.

Any arrangement of components to achieve the same functionality is effectively 'associated such that the desired functionality is achieved. Hence, any two components herein combined to achieve a particular functionality can be 'associated with' each other such that the desired functionality is achieved, irrespective of architectures or intermediary components. Likewise, two components so associated can also be viewed as being 'operably connected', or 'operably coupled' to each other to achieve the desired functionality.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term 'comprising' does not exclude the presence of other elements or steps.

Thus, an improved solution is described for inflatable platforms, and in particular an inflatable platform to provide a docking station for water-based motorised devices. The herein described system provides a safe and secure mechanism to restrain a relatively heavy water-based motorised device, thereby not only providing protection for the water-based motorised device but a place to secure them when not in use in the water. The inventor of the present invention has recognised and appreciated a number of problems with existing designs, which have been substantially alleviated with the concepts described herein.

The invention claimed is:

1. An inflatable water-based motorised device docking station comprising:

an V-shaped or U-shaped inflatable tube configurable to form an open ended area to receive a water-based motorised device;

a floor area substantially surrounded by coupled to a portion of the inflatable tube encompassing a range of 50-70% of an axial length with a margin of ±20% along each side of the V-shaped or U-shaped inflatable tube; and a ballast bag attached to the floor area with a dump arrangement and configured to stabilise the inflatable water-based motorised device docking station.

2. The inflatable water-based motorised device docking station of claim 1, wherein the inflatable water-based motorised device docking station is an individual inflatable water-based motorised device docking station configured to receive a single inflatable water-based motorised device.

3. The inflatable water-based motorised device docking station of claim 1, wherein the ballast dump arrangement is attached to the inflatable tube.

4. The inflatable water-based motorised device docking station as in claim 1, wherein the ballast bag with dump comprises a bag that is fixedly located into the floor by sewing the ballast bag into the floor or by gluing the ballast bag to the floor.

5. The inflatable water-based motorised device docking station of claim 4, wherein the ballast bag is coupled to a dump strap fixedly located into the inflatable water-based motorised device docking station such that a pulling up of the dump strap when the inflatable water-based motorised device docking station expels the water from the ballast.

6. The inflatable water-based motorised device docking station as in claim 1, wherein the floor comprises a weighted element configured to lower the floor when in use on water and ease access, where the weighted element comprises at least one weight configured in at least one of: a substantially central location to lower a central part of the floor and ease access, along an edge of the floor area facing an open end of the inflatable water-based motorised device docking station.

7. An inflatable water-based motorised device docking station comprising:

an inflatable tube configurable to form an open ended area to receive a water-based motorised device; a floor area coupled to a portion of the inflatable tube; and a ballast attached to the floor area and configured to stabilise the inflatable water-based motorised device docking station wherein the floor area encompasses less than 20% of an axial length along each side of a V-shaped or U-shaped inflatable tube for use in docking standard jet skis.

8. The inflatable water-based motorised device docking station of claim 1, further comprising a plurality of air-toggle loops configured to receive the inflatable tube when deflated and secure the inflatable tube when inflated.

9. The inflatable water-based motorised device docking station of claim 1, further comprising at least one handle containment strap connected to at least one D-ring attached to a surface of the inflatable tube whereby the at least one D-ring receives a second strap comprising two strips of Velcro™ securable onto each other when the second strap is passed through the D-ring.

10. A modular inflatable docking system as a kit of parts comprising an individual inflatable water-based motorised device docking station according to claim 1, having a first connectable element; and comprising at least one interconnectable device from a group of:

(i) at least one further individual inflatable water-based motorised device docking station having a first connectable element;

(ii) an inflatable platform comprising a second connectable element (iii) an anchor comprising a third connectable element.

* * * * *